US010874170B2

(12) United States Patent
Lopez

(10) Patent No.: US 10,874,170 B2
(45) Date of Patent: Dec. 29, 2020

(54) WATERPROOF BOOTSOCK

(71) Applicant: Robert Lopez, Brooklyn, NY (US)

(72) Inventor: Robert Lopez, Brooklyn, NY (US)

( * ) Notice: Subject to any disclaimer, the term of this patent is extended or adjusted under 35 U.S.C. 154(b) by 0 days.

(21) Appl. No.: 15/827,152

(22) Filed: Nov. 30, 2017

(65) Prior Publication Data

US 2019/0159549 A1 May 30, 2019

(51) Int. Cl.

| | |
|---|---|
| ***A43B 7/12*** | (2006.01) |
| ***A43B 19/00*** | (2006.01) |
| ***A43B 23/07*** | (2006.01) |
| ***A43B 3/04*** | (2006.01) |
| ***A41B 11/00*** | (2006.01) |
| ***A43B 23/08*** | (2006.01) |
| ***A43B 7/02*** | (2006.01) |
| ***A43B 3/00*** | (2006.01) |
| *A43B 5/04* | (2006.01) |

(52) U.S. Cl.

CPC ..... *A43B 19/00* (2013.01); *A41B 11/005* (2013.01); *A43B 3/0031* (2013.01); *A43B 3/04* (2013.01); *A43B 7/02* (2013.01); *A43B 7/12* (2013.01); *A43B 23/07* (2013.01); *A43B 23/088* (2013.01); *A43B 5/0405* (2013.01)

(58) Field of Classification Search

CPC .. A43B 7/12; A43B 7/02; A43B 23/07; A43B 23/088; A43B 3/0031

USPC ..... 36/9 R, 10, 55, 136

See application file for complete search history.

(56) References Cited

U.S. PATENT DOCUMENTS

| | | | | | |
|---|---|---|---|---|---|
| 912,398 | A * | 2/1909 | Mitchell | A43B 23/07 | 36/55 |
| 2,725,647 | A * | 12/1955 | Hugger | A43B 3/16 | 36/55 |
| 2,933,831 | A * | 4/1960 | Le Compte | A43B 3/02 | 24/659 |
| 3,000,118 | A * | 9/1961 | O'Shea | A43B 19/00 | 36/10 |
| 3,694,940 | A * | 10/1972 | Stohr | A43B 7/34 | 36/10 |
| 4,908,960 | A * | 3/1990 | Hoyt, Jr. | A43B 3/16 | 36/7.1 R |
| 5,133,088 | A * | 7/1992 | Dunlap | A41B 11/02 | 2/239 |
| 5,325,541 | A | 7/1994 | Willard | | |
| 5,575,014 | A * | 11/1996 | Kane | A41D 13/08 | 2/16 |
| 5,724,680 | A | 3/1998 | Cesnick | | |
| 6,665,883 | B2 | 12/2003 | Sloan | | |
| 6,880,173 | B2 | 4/2005 | Green | | |
| D565,284 | S * | 4/2008 | Miller | D2/909 | |
| 2004/0139628 | A1* | 7/2004 | Wiener | A43B 7/125 | 36/10 |
| 2007/0163145 | A1 | 7/2007 | Lavers | | |

(Continued)

*Primary Examiner* — Marie D Bays

(74) *Attorney, Agent, or Firm* — Zak Shusterman

(57) ABSTRACT

A disposable waterproof bootsock is worn over foot and sock to protect from exposure to liquids, dirt and other contaminants in an environment that can penetrate footwear or reach above the ankle. The bootsock is secured about the wearer's calf and ankle using fasteners that accommodate a range of calf and ankle sizes and allow adjustment to the wearer's desired fit while maintaining the bootsock in position upright. One or more sealed compartments are provided to hold essential supplies.

10 Claims, 4 Drawing Sheets

(56) References Cited

U.S. PATENT DOCUMENTS

2012/0030965 A1* 2/2012 Greene ..... A43B 9/00
36/10

* cited by examiner

WATERPROOF BOOTSOCK

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO COMPACT DISC APPENDIX

Not applicable.

BACKGROUND OF INVENTION

Field of the Invention

The present invention relates generally to foot coverings and more particularly to a new and useful disposable waterproof bootsock which is adapted to protect a wearer's feet and socks in conditions that may be wet, dirty, soiled or otherwise hazardous.

Background of the Related Art

The use of liners as a additional covering inside shoes, boots, or other footwear is well known in the prior art. Liners may serve any of several purposes, including retaining the warmth of feet, preventing injuries to feet due to abrasion with the inner surfaces or edges of footwear, or acting as a barrier between feet and undesirable matter that may penetrate into the footwear.

Individuals, especially construction workers, utility workers and emergency response personnel, often find themselves operating in difficult environments. In some of these environments, individuals may be required to walk through damp or soiled areas, through puddles of standing water, and even through hazardous conditions in which standing water contains raw sewage or other hazardous materials. Individuals participating in recreational activities, such as hunting, fishing, hiking, camping, boating, and watersports, also confront similar conditions. Therefore, it is desirable to provide a solution that protects feet and socks from liquid and other undesirable elements that may penetrate footwear or reach above the ankle.

During disaster relief efforts in particular, personnel are required to act quickly entering hazardous situations to save lives and prevent further damage. The delay in donning protective gear can cost precious moments. Therefore, it is desirable to provide a solution that allows protective gear to be applied and removed quickly in emergency situations.

One common solution is for individuals to first insert their socked feet into any available plastic bags, such as those commonly provided by grocery stores or the bags in which loaves of sliced bread are sold, and then inserting their bag-covered feet into their footwear. This solution provides only brief protection as these bags are not designed for this purpose. The durability of such coverings is unreliable, making the bags prone to rips and other failings after minimal abrasion inside footwear. Accordingly, it remains desirable to provide a solution for protecting feet and socks that is durable enough to endure the abrasive conditions expected inside footwear.

Another disadvantage of this solution is that such coverings are prone to sagging, making it difficult to maintain the covering's desired position above an individual's ankle and around their calf. This causes problems when attempting to lower a pant legs over the covering, at which point the covering is likely to be pushed down and expose the ankle and lower leg. A further problem results as the bag sags during use and exposes the ankle and lower leg. In either circumstance, it is possible that the individual is unaware that the bag has sagged or that the ankle and lower leg would now be vulnerable if the individual were required to proceed through some depth of water. It remains desirable to provide a solution that permits the waterproof covering to maintain its position above the ankle while being applied and throughout use in working conditions.

A further disadvantage of this and similar solutions is that it is not sufficiently durable by itself and still requires the use of footwear over the solution. In various offensive circumstances, more expensive footwear would be damaged or destroyed under such use while less expensive socks remain protected. It is further desirable to provide a durable solution capable of being used in circumstances where a wearer forgoes wearing footwear in environments that would destroy or render unusable such footwear.

In an alternative approach, a sock composed of an elastic and waterproof material is provided. The elastic sleeve is pulled on over the individual's bare or socked foot. One significant concern in using an elasticized sleeve of the sock is that the elasticized material will cause difficulty in pulling the sleeve over a bare or socked foot. This difficulty is increased where the sleeve is pulled over the bottom of a pant leg. Another concern is that the elastic material would cause continuous and uncomfortable pressure on the foot. A further concern is that the cost of using the elasticized material would be prohibitive for a disposable item. Therefore, it remains desirable to provide a waterproof solution that is not difficult to put on and that does not apply unnecessary pressure upon the foot.

Individuals using such solutions often confront obstacles and hazards beyond the need to protect one's feet and ankles. Existing solutions offer no assistance in addressing such additional problems. Therefore, it is desirable to provide a waterproof solution that provides additional utility with respect to other difficulties faced by its wearers.

It is, therefore, an object of this invention to provide a waterproof bootsock that will protect a wearer's foot and sock from becoming wet, soiled or contaminated from contact with external conditions that penetrate the wearer's footwear. An additional object of this invention is to provide a waterproof bootsock durable enough to be used without wearing additional footwear. Another object of this invention is to provide a waterproof bootsock that protects a wearer's leg and sock above the ankle when submerged in standing water or other bodies of liquid. A further object of this invention is to provide a waterproof bootsock that maintains its position about the ankle during dressing and ordinary usage. It is also an object of this invention to provide a waterproof bootsock that does not cause discomfort to the wearer's foot during ordinary use. Another object of this invention is to provide a waterproof sock that is easy to put on and remove. A further object of this invention is to provide a waterproof bootsock that is disposable and recyclable. A further object of this invention is to provide an bootsock with useful features for emergent situations, such as reflective material or sealed compartments pre-installed with emergency equipment. Another object of this invention is to assist the wearer in addressing exigent circumstances beyond protecting the wearer's feet.

SUMMARY OF INVENTION

Accordingly, the present invention contemplates a new and improved waterproof bootsock, and more particularly, a disposable bootsock that is easy to put on and which stays in place above the ankle. The invention eliminates the above-discussed and other drawbacks of the currently employed solutions.

The invention solves the problem of feet and socks becoming wet and soiled by providing a waterproof bootsock that serves as a durable and impermeable barrier to external elements. The problem of maintaining such protection above the ankle is further solved by providing vertical support and a means for easily and adjustably securing the bootsock in position. The problem of difficulty putting on a tight fitting elastic sock is solved by providing an oversized bootsock with calf recess that slips easily over a foot even when wearing a thick sock and encompasses the wearer's calf area. The problem of moisture build-up inside the bootsock is solved by providing an oversized bootsock that does not hold the foot tightly.

The invention is particularly suited for use by emergency and rescue personnel in disaster relief efforts. The waterproof bootsock can be applied quickly without significantly impacting the response times of disaster relief personnel. Similarly, the waterproof bootsock may be removed with ease and speed regardless of the presence of additional protective gear or equipment. Furthermore, the generous capacity of the bootsock provides the option for it to be worn over the pant leg, extending its protection to the bottom of the pant leg in addition to the wearer's foot, ankle and sock.

In one embodiment, a waterproof bootsock is provided that is loose fitting about the foot and with a means of securing the bootsock about the ankle.

In a further embodiment, a waterproof bootsock is provided with a plurality of points for securing the bootsock in place about the ankle.

In another embodiment, a waterproof bootsock is provided with one or more sealed compartments capable of storing reflective material and other emergency equipment.

BRIEF DESCRIPTION OF DRAWINGS

The invention may take physical form in certain parts and arrangements of parts, a preferred embodiment of which will be described in detail in this specification. Other objects and advantages of the invention will become apparent upon reading the following detailed description and upon reference to the accompanying drawing, in which.

DETAILED DESCRIPTION OF INVENTION

Figure 1:
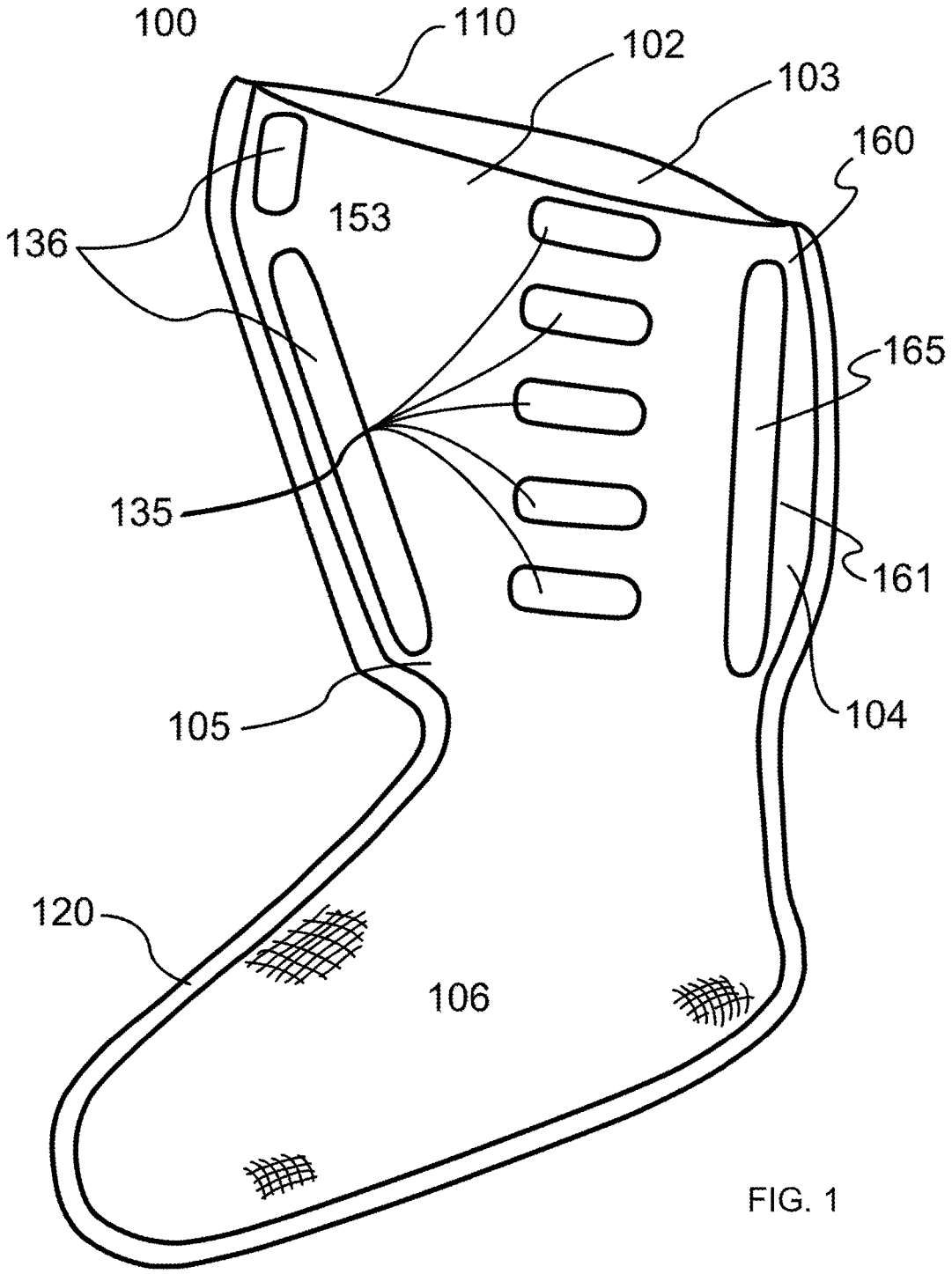
FIG. 1 is a side view of a first side of the bootsock in accordance with the invention.

While the invention is susceptible to various modifications and alternative forms, specific embodiments thereof have been shown by way of example in the drawings that are herein described in detail. It should be understood, however, that the description herein to specific embodiments is not intended to limit the invention to the particular forms disclosed, but on the contrary, the intention is to cover all modifications, equivalents, and alternatives falling within the spirit and scope of the invention. It will of course be appreciated that in the development of any such actual embodiment, numerous decisions specific to any particular implementation must be made to achieve the developers' goals, such as compliance with regulatory constraints, which will vary from one implementation to another. In the interest of clarity, not all features of an actual implementation are described in this specification. Moreover, it will be appreciated that such development effort might be complex and time-consuming, but would nevertheless be a routine undertaking for those of ordinary skill in the art having the benefit of this disclosure.

The bootsock components discussed herein may be composed of any of a number of sufficiently strong materials and may be formed or constructed by any of a number of processes. Nothing in the descriptions of the embodiments below is intended to be a limitation in the possible materials to be used in constructing any form of this invention.

Figure 2:
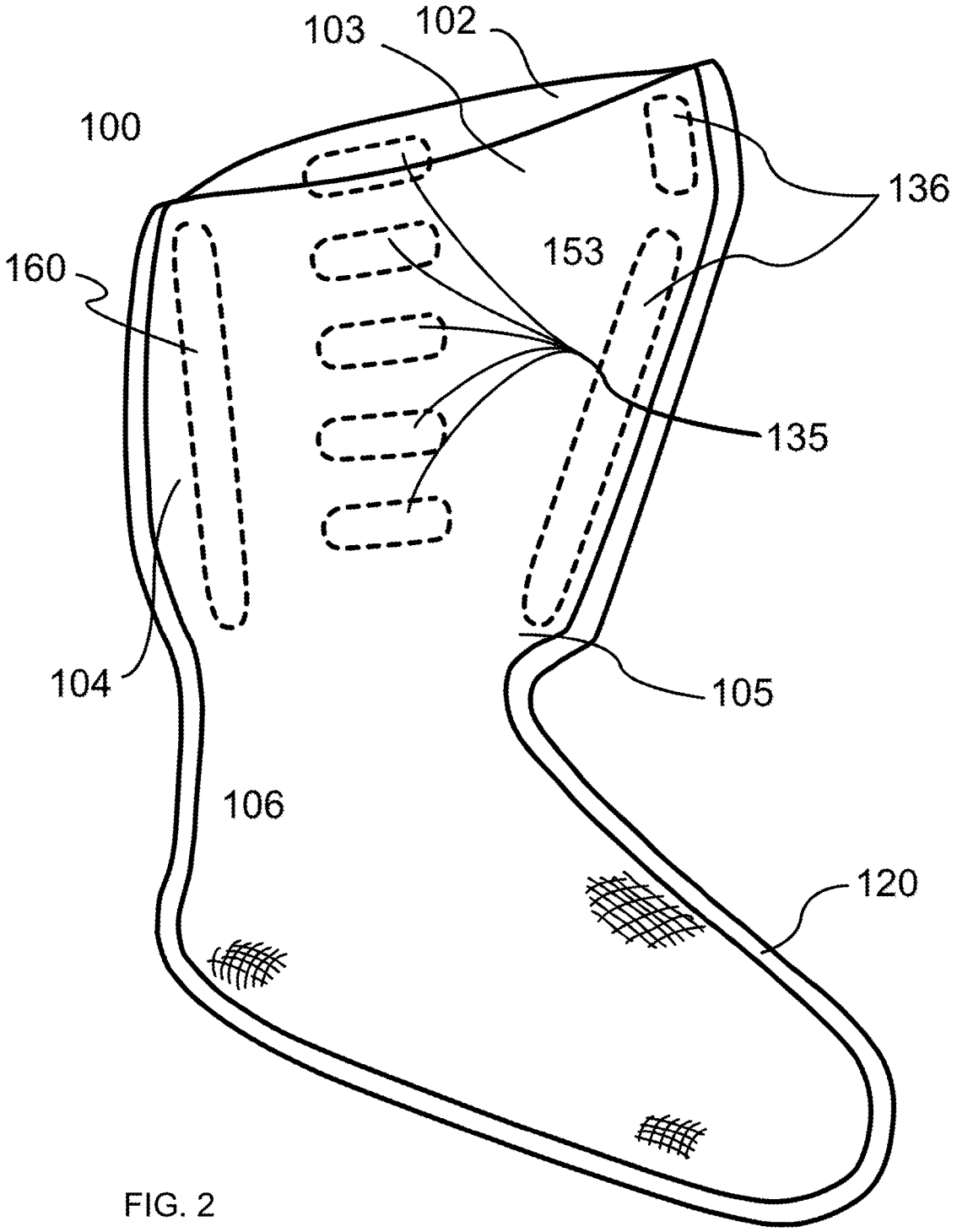
FIG. 2 is a side view of a second side of the bootsock of FIG. 1.

FIG. 1 is a side view of a first side of an embodiment of a bootsock 100. FIG. 2 is a side view of a second side of Bootsock 100. Bootsock 100 is comprised of two sheets, sheet 102 being forward facing in FIG. 1 and sheet 103 being forward facing in FIG. 2. Sheets 102 and 103 are comprised of appropriate material depending on intended use. For condition in which fully waterproof coverage is desired, the Sheets are comprised of polyurethane that is at least 0.003 inches thick. Alternatively, where breathability is desirable, the Sheets 102 and 103 are comprised of a material that prevents liquid from entering the Bootsock through the Sheets while permitting moisture to escape from the cavity of Bootstock 100 across the Sheets 102 and 103. Without doubt, any of a number of other materials meeting the requirements and characteristics of the preferred material could be employed.

Either the first side or the second side may be described as the left side or right side of Bootsock 100 as worn on a foot. Similarly, as worn on a foot, either the first side or the second side may be described as the interior or exterior of the foot and leg upon which Bootsock 100 is worn.

Bootsock 100 has the general shape of an oversized traditional sock or stocking with a wider opening than is traditionally provided. This embodiment of bootsock 100 further diverges from a traditional sock shape by providing an enlarged calf region 104 and enlarged ankle region 105. As worn, calf region 104 creates a recess into which the wearer's calf will situate. Calf region 104 will surround the wearer's calf, providing a more comfortable fit and additional support against sagging.

Bootsock 100 may be provided in a range of foot or shoe sizes with the understanding, however, that Bootsock 100 is oversized relative to the size of the intended foot to which it will be applied. Wearer's foot will rest within bootsock 100 adjacent to region 106.

The profile of Bootsock 100 is defined by an top edge 110 and seam 120 along the remaining perimeter of Bootsock 100. Seam 120 is a so-called double seam formed by heat sealing, radio frequency (RF) welding, ultrasonic welding or a similarly effective means of manufacture that produces a durable, watertight seal. The spacing between the two seams of seam 120 may vary. A larger spacing is depicted in the figures for the sake of clarity. As an artifact of manufacture, seam 120 may appear to continue along top edge 110. However, sheets 102 and 103 are not joined at top edge 110.

Top edge 110 defines the opening to the cavity of Bootsock 100 into which a wearer's foot would be inserted.

Patches 135 and 136 comprise a complementary fastening system. Any of a number of systems capable of selective securing Patch 135 to Patch 136, including hook and loop systems and selective adhesive systems would be appropriate. For purposes of this embodiment using a hook and loop system, patch 135 comprises a first fastening material with a loop surface and patch 136 comprises a second fastening material with a hook surface. For purposes of these specifications, a patch refers to the coverage of an area with one or more portions of the described material.

Reinforcing strip 160 is securely affixed to sheet 102 in the vicinity of calf region 104. When reinforcing strip 160 is affixed by means of seam 161 along the perimeter of reinforcing strip 160, sealed compartment 165 is formed between reinforcing strip 160 and sheet 102.

Alternatively, reinforcing strip 160 may be comprised of a thicker material than Sheets 102 and 103 to provide additional vertical support to Bootsock 100.

An item may be placed between reinforcing strip 160 and sheet 102, such that when seam 161 is formed, such item would be sealed within compartment 165. Where additional vertical support is desired, such item would be comprised of a rigid material. Where additional visibility is desired, such item would comprise a highly visible surface.

Figure 3:
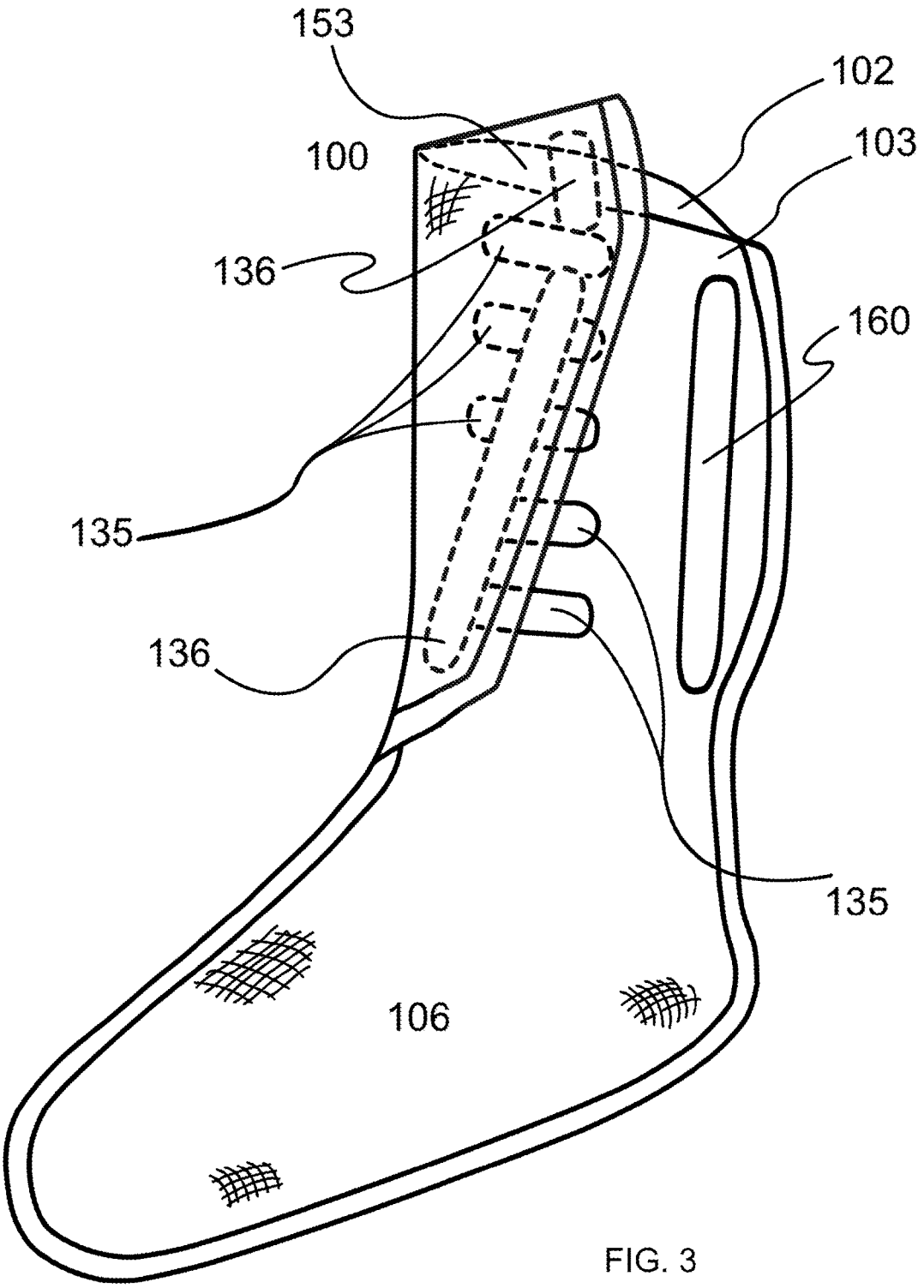
FIG. 3 is a side view of a first side of the bootsock of FIG. 1, as it would be secured in use.

FIG. 3 is a side view of a first side of a Bootsock 100 as it would appear in use.

Bootsock 100 is secured about a wearers leg by folding the portion of Bootsock 100 with patch 136 onto the portion of Bootsock 100 with patch 135. The fit of Bootsock 100 may be adjusted by pulling patch 136 and selectively attaching it along the expanse of patch 135. This individual adjustment allows the wearer to adjustably secure Bootsock 100 about a range of calf sizes and to customize the positioning to conform to wearer's desired fit.

The rigidity of patches 135 and 136, individually and when secured together, prevents flap region 153 of Bootsock 100 from sagging about wearer's calf and ankle. The rigidity of reinforcing strip 160 prevents Bootsock 100 from sagging about wearer's calf and ankle. Region 106 remains loose about wearer's foot before and after being secured.

Once secured, Bootsock 100 remains in place about wearer's foot, ankle, and calf, and protects wearer's foot. The wearer may then insert a Bootsock-enclosed foot into any other footwear. The low friction properties of sheets 102 and 103 allow the Bootsock and foot to be slipped into footwear with minimal resistance. Alternatively, as Bootsock 100 protects wearer's foot as well as any foot covering, the Bootsock may be used in lieu of footwear.

Figure 4:
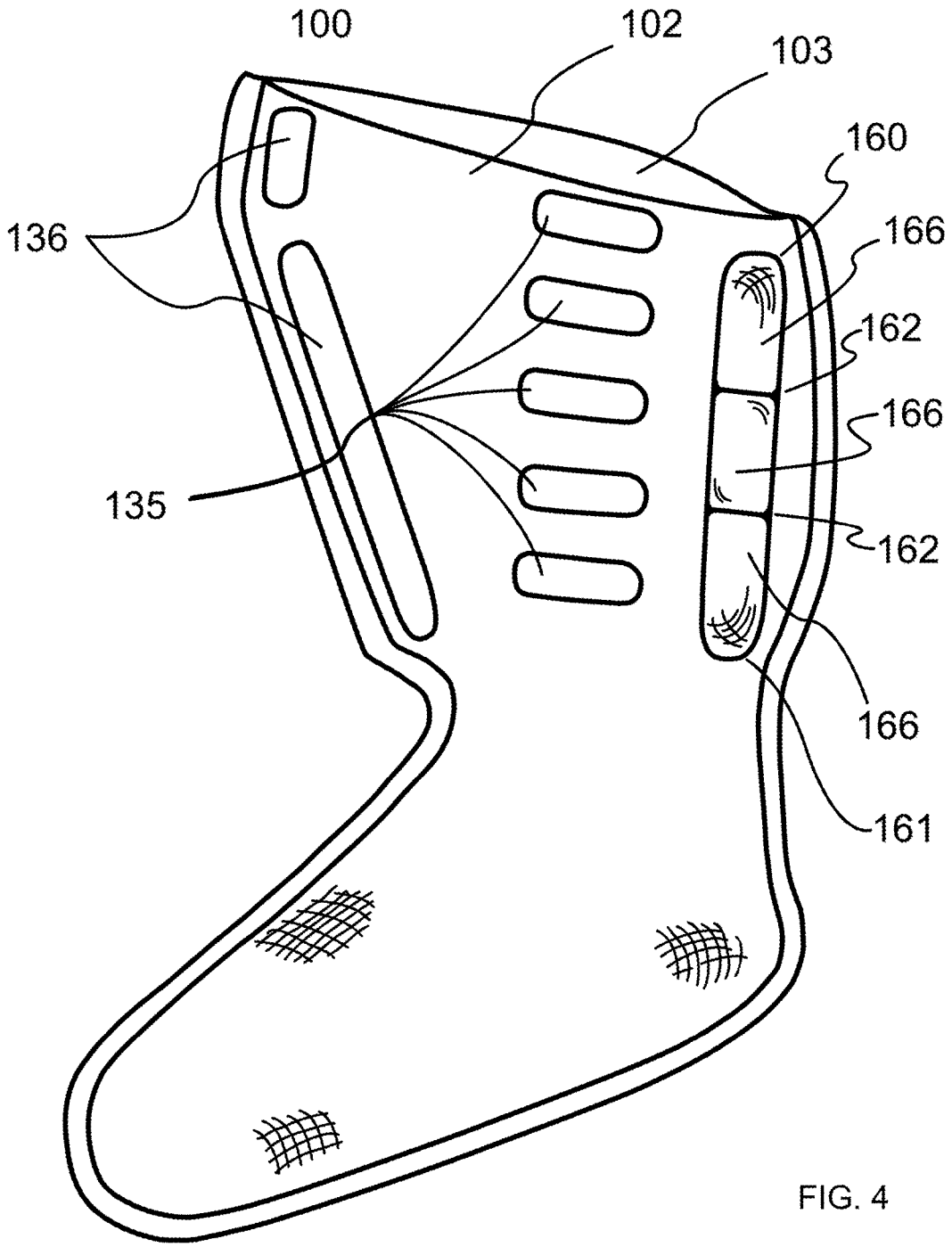
FIG. 4 is a side view of a first side of a second embodiment of the bootsock in accordance with the invention.

FIG. 4 is a side view of a first side of a second embodiment of Bootsock 100.

In this second embodiment, patches 135 and 136 continue to comprise a hook and loop fastening system used to selectively secure Bootsock 100 about wearer's ankle.

Reinforcing strip 160 is securely affixed to sheet 102 by means of seam 161 along the perimeter of reinforcing strip 160 and one or more seams 162 across reinforcing strip 160. A plurality of sealed compartments 166 are formed between reinforcing strip 160 and sheet 102. One or more items may be placed between reinforcing strip 160 and sheet 102, such that when seam 161 and seams 162 are formed, such items would be sealed within compartments 166. The contents of the compartments can vary with the intended uses of Bootsock 100. In some applications, brightly colored or reflective materials or a light emitter may be included in one or more compartments to provide increased visibility for the wearer. In other applications, the compartments may contain survival gear such as water purification tablets, fire-starters, or rescue transmitters.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. The invention should not be construed as limited to the specific form shown and described, but instead as set forth in the following claims.

What is claimed is:

1. A waterproof bootsock comprising:

a first sheet and a second sheet of waterproof material, said first sheet and said second sheet being identical to each other, each said first sheet and said second sheet made of polyurethane, each said first sheet and said second sheet having two surfaces, said surfaces being an internal surface facing the other said sheet and an external surface, each said first sheet and said second sheet having a perimeter defining a predetermined shape including at least a top edge, a leg portion and a foot portion, each said leg portion having a flap region, a mid region, an enlarged ankle region, and an enlarged calf region;

a first waterproof seam formed between said first sheet and said second sheet along said perimeter excluding the top edge, whereby an open top is formed between said top edges of said first sheet and said second sheet and a cavity is defined by said internal surfaces of said first and second sheets;

a means of securing said flap region of said first sheet to said mid region of said first sheet comprising a first patch of fastening material securely affixed to said flap region and a second patch of fastening material securely affixed to said mid region whereby said first patch can be secured to said second patch; and a strip having a perimeter, said strip being made of polyurethane and affixed to the calf region of the first sheet.

2. A waterproof bootsock as set forth in claim 1, wherein:

the strip is affixed to the first sheet by a second waterproof seam formed between the strip and the first sheet along the perimeter of the strip, said second waterproof seam being comprised of a plurality of positions; and further comprising one or more waterproof seams formed between the strip and the first sheet, starting at a first position on the second waterproof seam and ending at a second position on the second waterproof seam, whereby one or more sealed compartments are formed between the strip and the first sheet.

3. A waterproof bootsock as set forth in claim 1, wherein:

the strip is affixed to the first sheet by a second waterproof seam formed between the strip and the first sheet along the perimeter of the strip, said second waterproof seam being comprised of a plurality of positions; and further comprising a support material within said compartment.

4. A waterproof bootsock as set forth in claim 3, wherein:

the support material further comprises a bottom surface facing the first sheet and a top surface facing the strip, said top surface having reflective properties.

5. A waterproof bootsock as set forth in claim 1, wherein: the first sheet and the second sheet are made of polyurethane having antimicrobial properties.

6. A waterproof bootsock as set forth in claim 1, wherein: the first waterproof seam is a double seam comprised of two relatively parallel waterproof seams formed between the first sheet and the second sheet along the perimeter excluding the top edge, whereby an open top is formed between said top edges of said first sheet and said second sheet and a cavity is defined by said internal surfaces of said first and second sheets.

7. A waterproof bootsock as set forth in claim 1, further comprising:

a sole unit, said sole having cushioning properties, and said sole being affixed to the internal surface of the first sheet at the foot region and to the internal surface of the second sheet at the foot region.

8. A waterproof bootsock as set forth in claim 7, wherein: the sole unit further comprises a foot warmer.

9. A waterproof bootsock comprising:

a first sheet and a second sheet of waterproof material, said first sheet and said second sheet being identical to each other, each said first sheet and said second sheet made of polyurethane, each said first sheet and said second sheet having two surfaces, said surfaces being an internal surface facing the other said sheet and an external surface, each first sheet and said second sheet having a perimeter defining a predetermined shape including at least a top edge, a leg portion and a foot portion, said external surface of said leg portion of said first sheet having a flap region, a mid region, an ankle region, and an enlarged calf region;

a first waterproof seam formed between said first sheet and said second sheet along said perimeter excluding the top edge, whereby an open top is formed between said top edges of said first sheet and said second sheet and a cavity is defined by said internal surfaces of said first and second sheets;

a means of securing said flap region to said mid region comprising a first patch of fastening material securely affixed to said flap region and a second patch of fastening material securely affixed to said mid region whereby said first patch can be secured to said second patch;

a strip adjacent to the calf region of the first sheet having a perimeter and being made of polyurethane; and a second waterproof seam formed between the strip and the first sheet along the perimeter of the strip, whereby a sealed compartment is formed between the strip and the first sheet; and a support material within said compartment.

10. A waterproof bootsock comprising:

a first sheet and a second sheet of waterproof material, said first sheet and said second sheet being identical to each other, each said first sheet and said second sheet made of polyurethane, each said first sheet and said second sheet having two surfaces, said surfaces being an internal surface facing the other said sheet and an external surface, each first sheet and said second sheet having a perimeter defining a predetermined shape including at least a top edge, a leg portion and a foot portion, said external surface of said leg portion of said first sheet having a flap region, a mid region, an ankle region, and an enlarged calf region;

a first waterproof seam formed between said first sheet and said second sheet along said perimeter excluding the top edge, whereby an open top is formed between said top edges of said first sheet and said second sheet and a cavity is defined by said internal surfaces of said first and second sheets;

a means of securing said flap region to said mid region comprising a first patch of fastening material securely affixed to said flap region and a second patch of fastening material securely affixed to said mid region whereby said first patch can be secured to said second patch;

a strip having a perimeter, said strip being made of polyurethane and affixed to the calf region of the first sheet by a second waterproof seam formed between the strip and the first sheet along the perimeter of the strip, said second waterproof seam being comprised of a plurality of positions; and one or more waterproof seams formed between said strip and said first sheet, said seams extending from one position on the second waterproof seam to another position on the second waterproof seam, whereby one or more sealed compartments are formed between the strip and the first sheet.

* * * * *